US010025263B2

(12) United States Patent
Hatazaki

(10) Patent No.: US 10,025,263 B2
(45) Date of Patent: Jul. 17, 2018

(54) IMAGE FORMING APPARATUS WITH CLEANING SHEET REMAINING AMOUNT DETECTION

(71) Applicant: CANON KABUSHIKI KAISHA, Tokyo (JP)

(72) Inventor: Kazunari Hatazaki, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/489,847

(22) Filed: Apr. 18, 2017

(65) Prior Publication Data

US 2017/0219994 A1 Aug. 3, 2017

Related U.S. Application Data

(63) Continuation of application No. PCT/JP2015/081241, filed on Oct. 29, 2015.

(30) Foreign Application Priority Data

Oct. 30, 2014 (JP) ..... 2014-221435

(51) Int. Cl.
*G03G 15/20* (2006.01)
*G03G 21/16* (2006.01)

(52) U.S. Cl.
CPC ..... *G03G 21/1647* (2013.01); *G03G 21/169* (2013.01)

(58) Field of Classification Search
CPC ..... G03G 21/1685; G03G 15/2025; G03G 15/2035
USPC ..... 399/13, 24, 122, 327
See application file for complete search history.

(56) References Cited

U.S. PATENT DOCUMENTS 5,978,640 A * 11/1999 Segawa ..... G03G 15/2025 399/327
7,962,081 B2 * 6/2011 Russel et al. ..... G03G 15/2025 399/327
8,073,374 B2 * 12/2011 Halfyard et al. .. G03G 15/2025 399/327

FOREIGN PATENT DOCUMENTS

JP H02-82279 A 3/1990
JP H05-165267 A 7/1993
JP H06-194986 A 7/1994
JP 2004-212409 A 7/2004

OTHER PUBLICATIONS

International Search Report and Written Opinion dated Dec. 28, 2015, in Int'l Appln. No. PCT/JP2015/081241.

* cited by examiner

*Primary Examiner* — William J Royer
(74) *Attorney, Agent, or Firm* — Fitzpatrick, Cella, Harper & Scinto

(57) ABSTRACT

A locking arm for locking a cleaning unit using a cleaning sheet, a sensor for detecting a remaining amount of the cleaning sheet, a CPU for prohibiting an image forming operation depending on an output of the sensor, and an interrelating arm acting on the sensor so as to prohibit the image forming operation when locking by the locking arm is in an unlocked state.

15 Claims, 9 Drawing Sheets

IMAGE FORMING APPARATUS WITH CLEANING SHEET REMAINING AMOUNT DETECTION

This application is a continuation of PCT Application No. PCT/JP2015/081241, filed on Oct. 29, 2015.

TECHNICAL FIELD

The present invention relates to an image forming apparatus for forming a toner image on a recording material.

BACKGROUND ART

Conventionally, the image forming apparatus, such as a copying machine, a printer or FAX (facsimile machine), in which an image is formed using an electrophotographic process, has been known. The image forming apparatus of this type includes a fixing device for fixing the toner image on the recording material by heating and pressing the toner image.

In the fixing device, a cleaning device for cleaning offset toner transferred onto a fixing roller (heating portion) is provided (see Japanese Laid-Open Patent Application Hei 6-194986 and Japanese Laid-Open Patent Application 2004-212409).

Further, as such a cleaning device, a type using a cleaning sheet of a winding-up type (hereinafter, referred to as a web) has been known. Further, the cleaning device using the web is provided with a means for detecting a remaining amount of the web. Then, when the remaining amount of the web is in a small (little) state, notification to the effect that exchange of the web is prompted is made.

Therefore, in the case where the cleaning device is constituted as a cleaning unit detachably mountable to the image forming apparatus so that the web can be exchanged, in order to maintain a predetermined positional relationship with an object to be cleaned, the cleaning unit may preferably be locked. Further, on the other hand, for maintenance such as exchange of the cleaning unit, the cleaning unit is also in an unlocked state.

Thus, in the case where a mechanism for locking/unlocking the cleaning unit is provided, there is a liability that after the exchange of the cleaning unit, the cleaning unit is kept in the unlocked state due to an operational error. In such a state, there is a liability that the cleaning device cannot achieve sufficient cleaning performance. Recently, it is required to not only avoid such a situation but also achieve the sufficient cleaning performance without inviting an increase in cost.

SUMMARY OF THE INVENTION

Problem to be Solved by the Invention

An object of the present invention is to provide an image forming apparatus in which a cleaning device is capable of achieving sufficient cleaning performance.

Means for Solving the Problem

According to an aspect of the present invention, there is provided an image forming apparatus comprising: an image forming portion for forming a toner image on a recording material; a heating portion for heating the toner image formed on the recording material by the image forming portion; a cartridge including a cleaning sheet for cleaning the heating portion, a roller about which the cleaning sheet is wound, and a roller for winding up the cleaning sheet; a locking portion for locking said cartridge; a detecting portion for detecting a remaining amount of the cleaning sheet; a prohibiting portion for prohibiting an image forming operation depending on an output of the detecting portion; and an acting portion for acting on the detecting portion so as to prohibit the image forming operation when the locking portion is in an unlocked state.

EMBODIMENTS FOR CARRYING OUT THE INVENTION

In the following, embodiments for carrying out the present invention will be described with reference to embodiments relating to an image forming apparatus shown in the attached drawings. In the following embodiments, a structure of the image forming apparatus of an electrophotographic type using, as a heating portion (image heating apparatus), a fixing device for fixing a toner image will be described as an example. Incidentally, the embodiments shown below are only examples, and for example, as regards a detailed structure, a person skilled in the art can appropriately change it with a range not departing from the scope (object) of the present invention. Further, numerical values taken up in the embodiments are reference numerical values and do not limit the present invention.

[Embodiments]

In the following, the embodiments of the present invention will be specifically described with reference to the drawings.

(Image Forming Apparatus)

Figure 1:
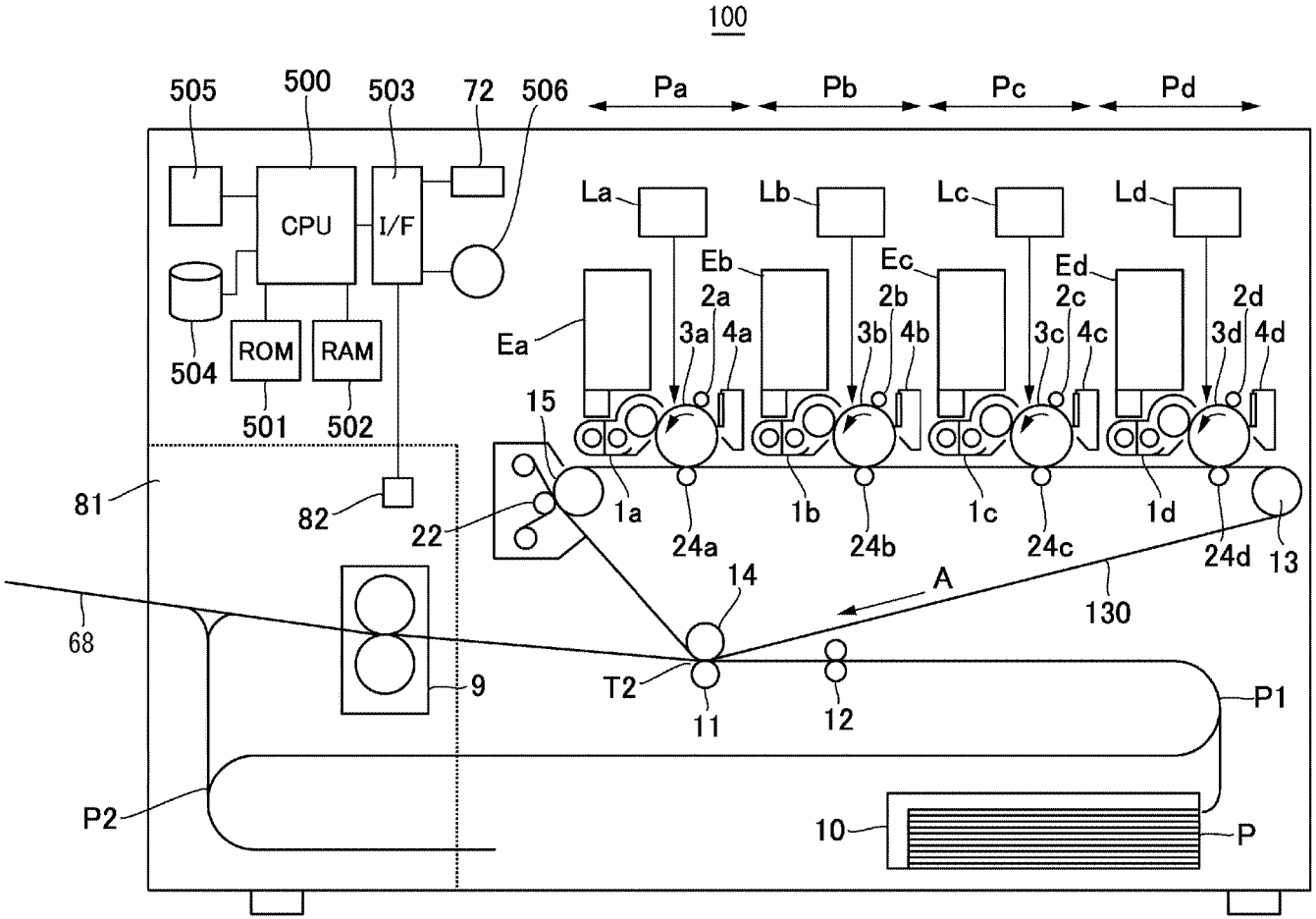
FIG. 1 is an illustration showing an example of a schematic structure of an image forming apparatus capable of carrying out the present invention.

FIG. 1 shows a structure of image forming portions and a control system of an image forming apparatus capable of carrying out the present invention. An image forming apparatus 100 in FIG. 1 is constituted as an intermediary transfer type full-color printer of a tandem type. An image forming mechanism thereof includes image forming portions Pa, Pb, Pc and Pd of an electrophotographic type, which are arranged along an intermediary transfer belt 130, for forming images of respective colors of yellow, magenta, cyan and black. Here, first, a flow of an entirety of image formation will be schematically described.

The image forming portions Pa, Pb, Pc and Pd include exposure devices La, Lb, Lc and Ld, photosensitive drums 3*a*, 3*b*, 3*c* and 3*d*, and developing devices 1*a*, 1*b*, 1*c* and 1*d*, respectively. At the respective image forming portions Pa, Pb, Pc and Pd, by the exposure devices La, Lb, Lc and Ld, photosensitive surfaces of the photosensitive drums 3*a*, 3*b*, 3*c* and 3*d* are irradiated with laser light beams modulated by image signals, so that electrostatic latent images corresponding to respective color components are formed. Thereafter, the electrostatic latent images on the photosensitive drums 3*a*, 3*b*, 3*c* and 3*d* are developed by the developing devices 1*a*, 1*b*, 1*c* and 1*d*, respectively, so that toner images of the respective colors of yellow, magenta, cyan and black are formed on the respective photosensitive drums 3*a*, 3*b*, 3*c* and 3*d*. The respective color toner images on the photosensitive drums 3*a*, 3*b*, 3*c* and 3*d* are timed to each other and are transferred onto the intermediary transfer belt 130. The four color toner images transferred on the intermediary transfer belt 130 are fed to a position of secondary transfer rollers 11 and 14, and then are secondary-transferred onto a sheet P.

The sheet P as the recording material onto which this toner image is transferred is formed of a material such as paper or plastics, for example, and is accommodated in a sheet cassette 10 at a lower portion of image forming apparatus 100. The sheet P is fed one by one from the sheet cassette 10 by an unshown pick-up roller or the like, and is fed in an S-shaped feeding path P1 as shown in FIG. 1 and reaches a position of registration rollers 12.

The registration rollers 12 send the sheet P to a secondary transfer portion T2 while being timed to the toner images on the intermediary transfer belt 130. The sheet P on which the four color toner images are secondary-transferred at the secondary transfer portion T2 from the intermediary transfer belt 130 is subjected to a heat-fixing (heating and pressing) process of a fixing device 9, so that the toner images are fixed thereon, and thereafter the sheet P is discharged onto a discharge tray 68 outside image forming apparatus 100 (machine).

In the case of double-side printing, the sheet P on which the toner images are fixed on a first surface by the fixing device 9 is induced into a reversing path P2 and is switched back to be turned upside down so as to replace a leading end and a trailing end with each other, and then is fed again to the feeding path P1 and is fed again to the registration rollers 12. Then, at the secondary transfer portion T2, the toner images are transferred onto the second surface of the sheet P, and then are fixed by the fixing device 9, and thereafter the sheet P is discharged onto the discharge tray 68.

Incidentally, in the image forming apparatus 100 in this embodiment, the above-described photosensitive drums 3*a*, 3*b*, 3*c* and 3*d*, the respective feeding rollers, belts and the like are driven by unshown driving mechanism and driving source, and driving timing of these members is synchronously controlled by a control device (control system) principally including a CPU 500 described later.

(Image Forming Portion)

Here, a constitution of the image forming portions Pa, Pb, Pc and Pd and a periphery of the intermediary transfer belt 130 will be described in detail. The image forming portions Pa, Pb, Pc and Pd have the substantially same constitution except that the colors of toners of yellow, magenta, cyan and black used in developing devices 1*a*, 1*b*, 1*c* and 1*d* are different from each other. Accordingly, in the following description, the image forming portion Pa will be described and other image forming portions Pb, Pc and Pd will be omitted from redundant description. Structures of the other image forming portions Pb, Pc and Pd which are not specifically described below correspond to constitutions in which suffixes of respective members having the reference symbol a are read as b, c and d.

The image forming portion Pa is constituted so that a charging device 2*a*, the exposure device La, the developing device 1*a*, a transfer roller 24*a*, and a drum cleaning device 4*a* are provided so as to surround the photosensitive drum 3*a*. The photosensitive drum 3*a* is prepared by forming a photosensitive layer on an outer peripheral surface of an aluminum cylinder, for example, and is rotationally driven in an arrow direction at a predetermined process speed.

The charging device 2*a* electrically charges the surface of the photosensitive drum 3*a* to a uniform potential (polarity is a negative polarity, for example). The exposure device La forms an electrostatic image on the photosensitive drum 3*a* by scanning through a rotating mirror with a laser beam obtained by subjecting a scanning line image signal, corresponding to an image of a recording color (yellow in this case), to ON-OFF modulation. Incidentally, in FIG. 1, the exposure devices La, Lb, Lc and Ld corresponding to respective recording colors are illustrated as separate blocks, but a part of an optical system is common to the respective recording colors in some cases, and an actual structure is arbitrary. Structures of these exposure devices do not constitute the present invention.

The developing device 1*a* develops the electrostatic image into the toner image by transferring the toner onto the photosensitive drum 3*a*. A toner cartridge Ea provided together with the developing device 1*a* supplies the toner, in an amount correspondingly to an amount consumed by the image formation, to the developing device 1*a*. The transfer roller 24*a* urges the intermediary transfer belt 130 to form a transfer portion between the photosensitive drum 3*a* and the intermediary transfer belt 130. Further, by applying a positive DC voltage to the transfer roller 24*a*, for example, the negative toner image carried on the photosensitive drum 3*a* is transferred onto the intermediary transfer belt 130.

The intermediary transfer belt 130 is stretched and supported by a tension roller 15, the secondary transfer roller 14 and a driving roller 13, and is driven and rotated in an arrow A direction by the driving roller 13. The secondary transfer roller 11 is provided opposed to the secondary transfer roller 14 inside the intermediary transfer belt 130 and contacts the intermediary transfer belt 130, whereby the secondary transfer portion T2 is formed. By applying, e.g., a positive DC voltage to this secondary transfer roller 11, the toner image is transferred from the intermediary transfer belt 130 onto the sheet P passing through a position of the secondary transfer portion T2.

The drum cleaning device 4*a* of the image forming portion Pa rubs the photosensitive drum 3*a* with, e.g., a cleaning blade to collect a transfer residual toner on the photosensitive drum 3*a*. Further, as regards the intermediary transfer belt 130, a belt cleaning device 22 is provided at a position of the tension roller 15.

The belt cleaning device 22 may be constituted from a cleaning mechanism using a cleaning blade, for example, or may also be constituted by a web cleaning type similarly as a cleaning unit used for the fixing device 9 described later. In the case of the web cleaning type, a belt cleaning device 22 rubs the intermediary transfer belt 130 with a cleaning web to collect a transfer residual toner on the intermediary transfer belt 130.

The developing device 1*a* is capable of using the toner containing (incorporating), e.g., paraffin, a wax consisting of polyolefin or a silicone oil as a parting agent. A so-called polymerization toner of this type can be manufactured by finely dispersing a wax component and a pigment into a pulverized toner, for example. An object of use of the toner containing the parting agent as described above is to prevent offset of the toner onto a fixing roller 40 of the fixing device 9 described later, for example. The toner as described above is accommodated in the toner cartridge Ea, for example, and is supplied from the toner cartridge Ea to the developing device 1*a*.

The respective color toner images formed by the above-constituted image forming portion Pa and the image forming portions Pb, Pc and Pd having a similar constitution are transferred to the intermediary transfer belt 130 and are fed to the position of the secondary transfer portion T2. Then, at the position of the secondary transfer portion T2, the toner images on the intermediary transfer belt 130 are transferred onto the sheet P.

The sheet P on which the toner images are transferred is fed to the fixing device 9 on the feeding path P1. The fixing device 9 fixes the toner images transferred on the sheet P by heating and pressing the toner images. The constitution of a periphery of the fixing device 9 will be specifically described later.

(Control System)

The image forming apparatus 100 in FIG. 1 includes a control system as shown at an upper left portion of the figure. This control system includes, as a main control portion (controller), the CPU 500 consisting of a general-purpose microprocessor or the like, for example.

The CPU 500 constitutes the main controller for controlling an entirety of an image forming operation of the image forming apparatus 100 in this embodiment. Particularly, in this embodiment, the CPU 500 constitutes a permitting means (permitting portion) for permitting the image forming operation or a prohibiting means (prohibiting portion) for prohibiting the image forming operation depending on detection of a remaining amount of a cleaning sheet 61 of a cleaning unit 60 described later.

As described later, the cleaning unit 60 accommodates a non-endless cleaning sheet 61 for cleaning a rotatable heating member (fixing roller 40) for heating the toner images formed by the image forming portions Pa, Pb, Pc and Pd. This cleaning unit 60 includes a winding-up mechanism (web supplying roller 61*a*-web cleaning unit roller 61*b*) for winding up the cleaning sheet 61 and is constituted as a detachably mountable cartridge.

Further, in this embodiment, a photo-sensor (photo-interrupter) 72 and a remaining amount detecting flag which are used as a detecting means (detecting portion) for detecting the remaining amount of the cleaning sheet 61 are provided. Particularly, the above-described prohibiting means constituted using the CPU 500 prohibits the image forming operation depending on an output of the detecting means. Or, depending on a mode of the remaining amount detection, the above-described permitting means constituted using the CPU 500 permits the number of times of the image forming operation corresponding to the remaining amount of the cleaning sheet 61.

Further, in this embodiment, the cleaning unit (cartridge) 60 having the detachably mountable cartridge constitution is locked to a principal portion of a cleaning device 600. For that reason, a locking means (locking portion) including a dial-shaped web locking knob 73, a locking arm 74 and the like is provided. Further, in this embodiment, as described later, when the locking means is in a locking-released state, (proper cleaning cannot be performed and therefore) an acting means (acting portion, interrelating portion) acting on the detecting means (photo-sensor 72, photo-interrupter 77 and the like) is provided so that the image forming operation is prohibited. This acting means is principally constituted, in an example described later, by the photo-sensor 72 and photo-interrupter 77 as the detecting means and an interrelating arm 75 for interrelating the locking arm 74 as the locking means, for example. Thus, a locked state of the cleaning unit 60 having the detachably mountable cartridge constitution is detected by using the (remaining amount) detecting means for detecting the remaining amount of the cleaning sheet 61, and when the locking means is in the locking-released state, control is carried out so as to prohibit the image forming operation.

Incidentally, naturally, when the locking means for locking the cleaning unit 60 having the cartridge constitution is in the locked state, control is carried out so as to permit the image forming operation. For example, the above-described acting means (e.g., the interrelating arm 75) is constituted so as to be in a non-acting state on the remaining amount detecting means for the cleaning sheet 61 when the locking means for locking the cleaning unit 60 is in the locked state.

To a system bus of the CPU 500, memories such as an ROM 501 and an RAM 502 are connected. The ROM 501 can be used for storing a control program of the CPU 500 described later, for example. In that case, the ROM 501 is exchanged or constituted by a device such as E(E)PROM capable of rewriting a part of an area thereof, and then the control program according to the present invention can be renewed by a method in which contents of the device is rewritten or the like. The RAM 502 is used as a working area of the CPU 500 or a cash memory of image data relating to image formation.

The CPU 500 controls an operation of an entirety of the apparatus, but in a block diagram of FIG. 1 at an upper left portion, as a representative of a member to be controlled by the CPU 500, particularly only one block (circle mark) of a driven portion 506 is shown. This driven portion 506 represents a motor, a solenoid, various sensors and the like which are provided in a feeding system such as the sheet P, the intermediary transfer belt 130, the fixing device 9 and the like, for example. The driven portion 506 is connected to the system bus of the CPU 500 via an interface 503 constituted by a driver circuit suitable for the motor, the solenoid, the various sensors and the like used in the driven portion 506 and by an interface circuit with the system bus.

Further, to the system bus of the CPU 500, an external storing device 504 can also be connected. The external storing device 504 can be constituted by a disk device such as HDD or SSD, an optical disk device using media such as CD-ROM and DVD, or various flash memories. Also this external storing device 504 can be used for storing the control program of the CPU 500 described later, for example. Particularly, in the case where the external storing device 504 uses a detachably mountable memory device such as the optical disk or the flash memory, this memory device can be used as a computer readable recording medium for supplying the control program according to the present invention.

Further, to the system bus of the CPU 500, as a user interface means, e.g., an operating panel 505 is connected. The operating panel 505 is constituted by a display device such as an LED panel, a keyboard (or a touch panel), or further a voice (audio) outputting device such as a voice synthesizing means, an amplifying circuit, a speaker or the like. The operating panel (display portion) 505 is capable of displaying not only an image formation instruction, a display for designating an image forming condition, a display of an operating state of the apparatus (device) and the like, but also a message, such as warning information, to a user. Particularly, in a control procedure described later, the operating panel 505 can be used as a notifying means (notifying portion) for outputting warning information for warning a small remaining amount state of the cleaning sheet 61. For outputting this warning information (warning message), the display outputting means or the voice synthesizing and outputting means as described above is used.

Further, to the interface 503, as a remaining amount sensor for detecting the remaining amount of the cleaning sheet 61 of the cleaning device 600 provided together with the fixing device 9 described later, the photo-sensor 72 is connected. By this, the CPU 500 can read a detection state of the photo-sensor 72 via the interface 503.

Further, to the interface 503, for the purpose of maintenance or the like, a sensor 82 for detecting an open and close state of a door (exchange door) 81 for permitting access to an inside of an apparatus casing of the image forming apparatus 100. The door 81 is opened and closed for performing maintenance of the cleaning device 600 provided together with the fixing device 9, for example. In FIG. 1, the door 81 is illustrated so as to be provided at a position of a lower-left front surface, but the position and a size thereof are arbitrary, and for example, the door 81 may be disposed at a side surface of the image forming apparatus 100 or may be constituted with a size such that the door 81 is opened and closed in a relatively large range at a lower portion of a front surface. The sensor 82 can be constituted by an arbitrary sensor device, capable of detecting an open and close state of the door 81, such as a photo-sensor or a limit switch for detecting a tab provided on the door 81. The CPU 500 can read a detected state of the sensor 82 via the interface 503.

(Fixing Device)

Figure 2:
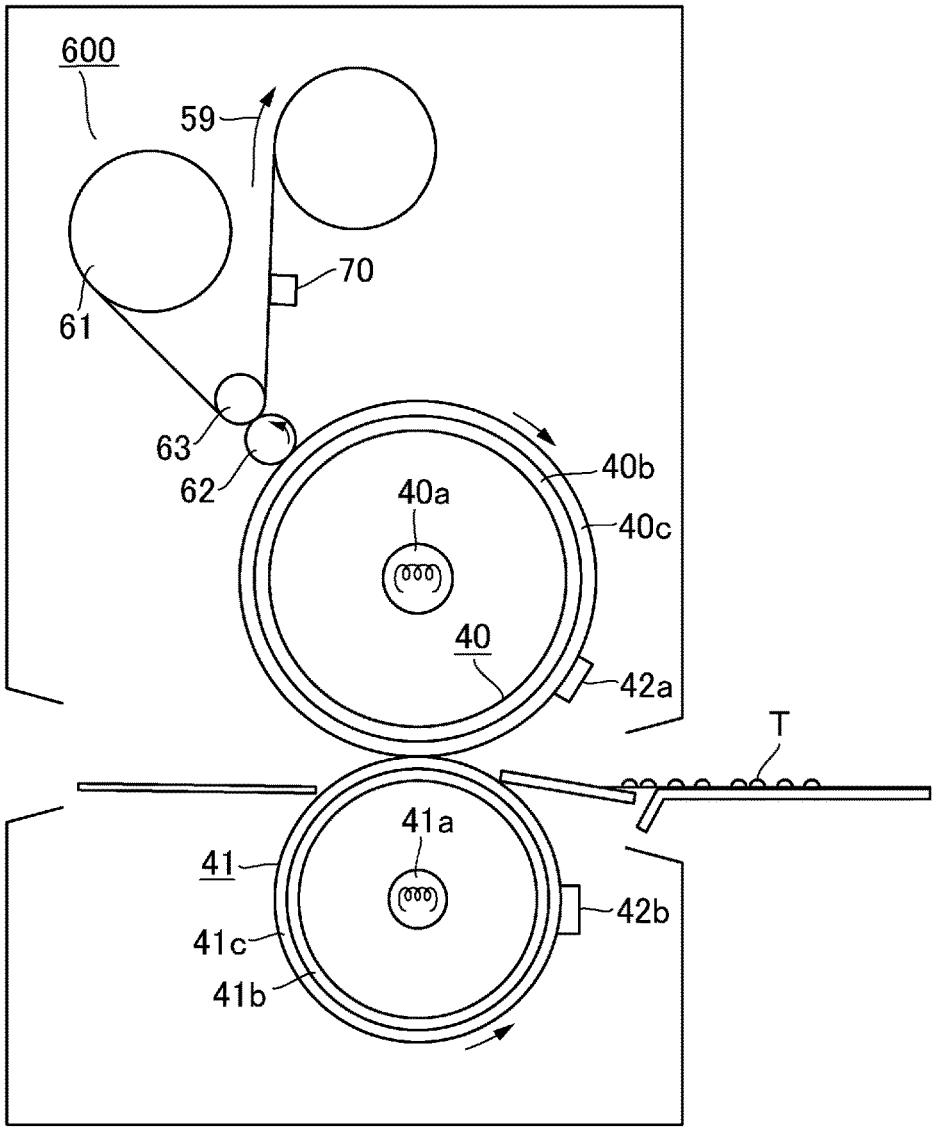
FIG. 2 is an illustration showing a structure of a fixing device as an example of a heating (process) device in the image forming apparatus of FIG. 1.

A peripheral structure of the fixing device 9 in this embodiment is shown in FIG. 2. The fixing device 9 in this embodiment includes the fixing roller 40 as a rotatable heating member for heating the toner images formed on the recording material (sheet P). In this embodiment, with regard to this fixing device 9, the cleaning device 600 for removing the toner offset (transferred) from the sheet P is disposed for the fixing roller 40. The cleaning device 600 is constituted by a web cleaning mechanism. In this embodiment, the cleaning unit 60 having the cartridge mechanism is mounted to and demounted from the cleaning device 600, and a structure for locking and unlocking (lock-releasing) will be described later in detail. In FIG. 2, a functional relationship between the cleaning device 600 and the fixing roller 40 will be principally described.

FIG. 2 shows a schematic sectional structure of the fixing device 9, and the sheet P on which unfixed toner images T are formed as described above is fed into the fixing device 9 from a right side of FIG. 2. The fixing roller 40 and a pressing roller 41 are connected with each other by an unshown gear mechanism connecting gears fixed to shaft ends thereof in one side, for example, and are rotationally driven integrally by an unshown driving system, thus being rotated in arrow directions, respectively. The pressing roller 41 is constituted so as to be press-contacted to the fixing roller 40 at a total pressure of, e.g., about 784 N (about 80 kgf), so that a nip for nipping the sheet P is formed. The sheet P is nipped and fed by a heating nip between the fixing roller 40 and the pressing roller 41, and by this, the toner images T are fixed on the sheet P (fixing by heating and pressing).

The fixing roller 40 is rotatably supported via bearings by unshown ball bearings or the like at both end portions thereof. The fixing roller 40 is constituted in a diameter of, e.g., about 60 mm by disposing an about 3 mm-thick elastic layer 40*c* on an outer peripheral surface of a core metal 40*b* consisting of, e.g., a hollow aluminum cylinder or the like. A lower layer of the elastic layer 40*c* is, e.g., a HTV (high-temperature vulcanizing) silicone rubber layer, and on an outer peripheral surface of this HTV silicone rubber layer, an RTV (room-temperature vulcanizing) silicone rubber layer is disposed as a heat-resistant elastic layer directly contacting an image surface of the sheet P. At a rotation center of the fixing roller 40, inside the core metal 40*b*, a halogen heater 40*a* for heating the fixing roller 40 from an inside is disposed. This halogen heater 40*a* inside this core metal 40*b* is supported, e.g., in a non-rotation state, by an unshown supporting means.

The pressing roller 41 contacting the fixing roller 40 is rotatably supported via bearings by unshown ball bearings or the like at both end portions thereof. The pressing roller 41 is constituted in a diameter of 60 mm by disposing an about 1 mm-thick elastic layer 41*c* on an outer peripheral surface of an aluminum cylindrical core metal 41*b*. A lower layer of the elastic layer 41*c* is, e.g., a HTV silicone rubber layer, and on an outer peripheral surface of this HTV silicone rubber layer, e.g., a fluorine-containing resin layer is disposed as a parting layer. At a rotation center of the pressing roller 41, inside the core metal 41*b*, a halogen heater 41*a* for heating the pressing roller 41 from an inside is disposed non-rotatably. Also the halogen heater 41*a* inside this core metal 41*b* is supported, e.g., in a non-rotation state, by an unshown supporting means.

By combining the fixing roller 40 and the pressing roller 41 each having the layer structure as described above, the parting property against a sharp-melt toner can be further enhanced even in the case where a so-called sharp melt toner such that the toner is abruptly melted at a certain temperature or more, for example. Further, at not only the surface of the fixing roller 40 but also the surface of the pressing roller 41, RTV or LTV (low-temperature vulcanizing) silicone rubber having a high toner parting effect is used, whereby it is possible to meet fixing of double-side images.

In order to control the fixing temperature, a thermistor 42*a* is provided in contact with the surface of the fixing roller 40, and a thermistor 42*b* is provided in contact with the surface of the pressing roller 41. The thermistors 42*a* and 42*b* are included in the driven portion 506 of the above-described control system. The temperature control of the fixing roller 40 and the pressing roller 41 can be carried out by a temperature adjusting means constituted by the above-described CPU 500 and a software thereof, for example.

This temperature adjusting means carries out the temperature control of the fixing roller 40 and the pressing roller 41 by adjusting electric power supplied to the halogen heaters 40*a* and 41*a* inside the core metals 40*b*, 41*b* depending on detection values of the thermistors 42*a* and 42*b*, for example. In that case, the electric power supplied to the halogen heater 40*a* inside the core metal 40*b* is adjusted so that a surface temperature of the fixing roller 40 converges to a target temperature (about 165° C.), for example. Further, as regards the pressing roller 41, the electric power supplied to the halogen heater 41*a* inside the core metal 41*b* is adjusted so that a surface temperature of the pressing roller 41 converges to a target temperature (about 140° C.).

An optimum heating quantity for melting the toner image on the sheet P is different depending on a thickness or a weight per unit area (basis weight) of the sheet P, and therefore the CPU 500 changes the target temperature for temperature adjustment of the fixing roller 40 depending on a species of the sheet P. However, it takes a time from a change of the target temperature until the surface temperature of the fixing roller 40 converges to the target temperature, and therefore the target temperature is set at a high value correspondingly to the sheet P requiring a large heat quantity, so that the sheets P of many species are heated at the same temperature. In this case, with respect to the sheet P not requiring so large heat quantity, the heat quantity becomes excessively large, so that a hot offset phenomenon such that the melted toner is transferred from the sheet P onto the fixing roller 40 is liable to occur.

The cleaning device 600 feeds the cleaning sheet 61 (cleaning web), wound in a roll shape by an unshown driving means, in an arrow direction 59 while winding up the cleaning sheet 61 little by little in synchronism with the image forming process. A cleaning portion contributing to the cleaning of the cleaning sheet 61 is contacted to a member-to-be-cleaned by a web roller 63. Incidentally, in this embodiment, the cleaning sheet 61 is not directly contacted to the fixing roller 40, but for example, a collecting roller 62 as a collecting member or a rotatable collecting member for collecting a deposited foreign matter is provided. This collecting roller 62 contacts the cleaning sheet 61 toward the web roller 63 and is disposed so as to rotate in contact with the fixing roller 40, so that the cleaning sheet 61 is rubbed with the collecting roller 62. Thus, the collecting roller 62 functions so that the cleaning sheet 61 and the fixing roller 40 are indirectly contacted to each other.

Incidentally, depending on a combination of materials, a structure such that the cleaning sheet 61 is directly contacted to the fixing roller 40 which is the member-to-be-cleaned may also be employed. However, in such a structure, there is also a possibility that the fixing roller 40 is damaged by the cleaning sheet 61 itself or the foreign matter deposited on the cleaning sheet 61 and thus a stripe is formed on a recording image. On the other hand, according to a structure in which the cleaning sheet 61 is indirectly contacted via the collecting roller 62, it is possible to avoid the lowering in recording image quality as described above.

(Cleaning Device)

FIG. 12 and FIGS. 3 to 9 show an example of a structure of the cleaning device 600 disposed together with the fixing device 9 in this embodiment. The cleaning device 600 includes, e.g., an exchangeable cleaning unit 60. Incidentally, as regards the cleaning unit 60 portion, there is a case that from a mounting and demounting structure, for example, as a name regarding supply and selling, a designation such as a "cleaning cartridge" or simply a "cartridge" is used in some instances. In the following, description will be made subsequently using the designation of the "cleaning unit". Incidentally, in the following, materials of respective mechanical members constituting the fixing device 9 and the cleaning device 600 can be selected by the person skilled in the art from arbitrary materials such as metals and plastics depending on specifications or the like of operations of the respective members.

Incidentally, the fixing device 9 in which the cleaning device 600 is disposed corresponds to a heating (process) device of the image forming apparatus of an electrophotographic type, for example. However, the cleaning device 600 and the mounting and demounting mechanism thereof which are described below in detail can be similarly carried out even in the case where the device and the mechanism are provided along with the heating device disposed as a gloss improving device or the like.

First, using FIG. 12, in the cleaning device 600 in this embodiment, an example of a structure for fixing (locking) or fixing-releasing (unlocking) the cleaning unit 60 will be described.

Figure 12:
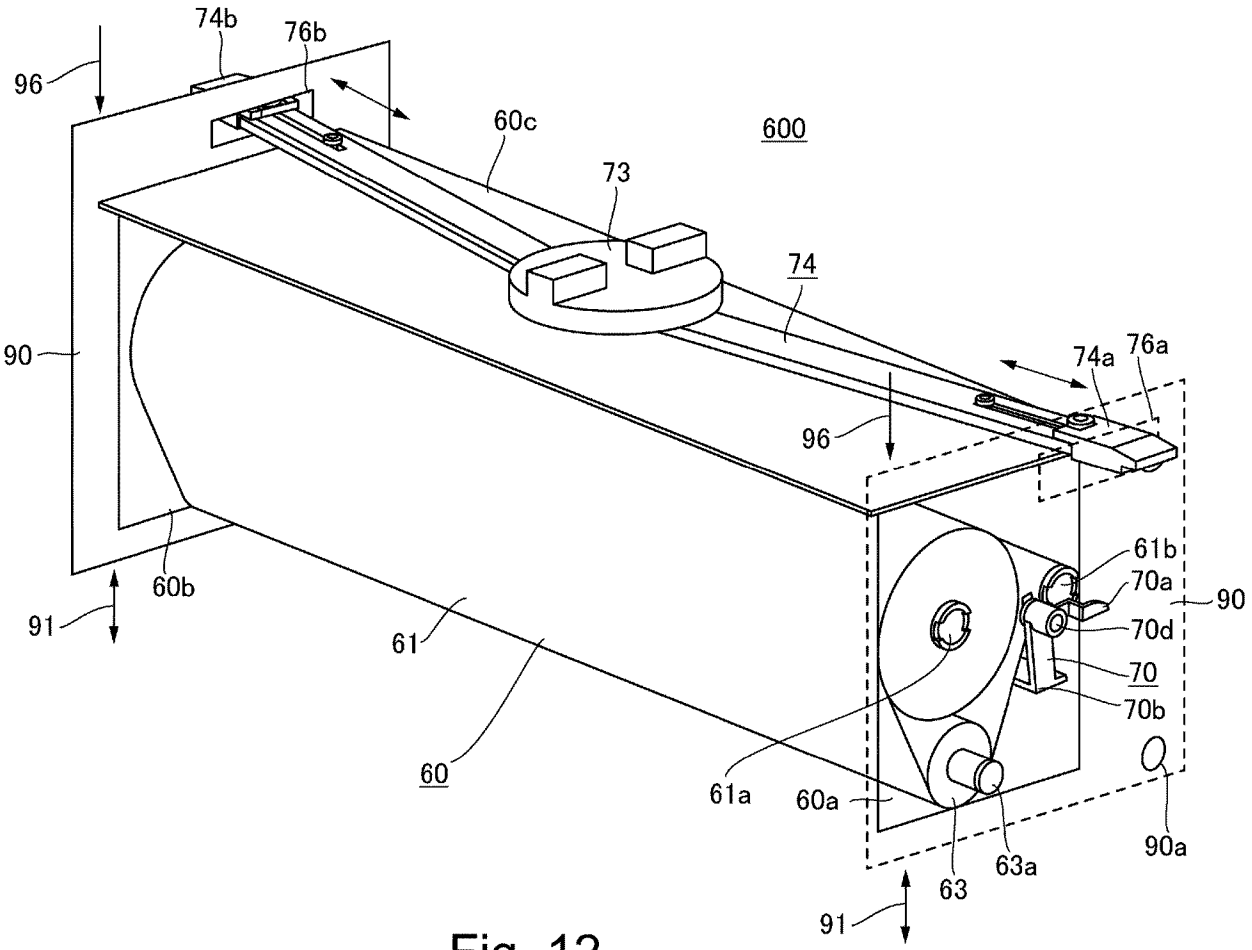
FIG. 12 is a perspective view showing a structure of a locking mechanism of the cleaning unit.

As shown in FIG. 12, the cleaning unit 60 includes, for example, left and right side plates 60*a* and 60*b* and a top plate 60*c*, and by these, a frame of the cleaning unit 60 is constituted. The cleaning sheet 61 is mounted and charged, in the cleaning unit 60, in a state of being wound up by the web supplying roller 61*a*, and one end thereof is pulled out from an outside thereof, so that the cleaning sheet 61 is stretched and mounted so as to be wound up by a web cleaning unit roller 61*b*. Further, at an intermediary portion between the web supplying roller 61*a* and the web cleaning unit roller 61*b*, the cleaning sheet 61 is stretched and extended around the web roller 63 pressed (urged) against the collecting roller 62 by an urging mechanism (FIG. 3) described later. By this web roller 63, a cleaning portion of the cleaning sheet 61 is slid on the fixing roller 40 (via the collecting roller 62).

The web supplying roller 61*a*, the web cleaning unit roller 61*b* and a shaft 63*a* of the web roller 63 around which the cleaning sheet 61 is wound and mounted are shaft-supported between particularly the left and right side plates 60*a* and 60*b*. Of these, for example, an end portion where at least a cut-away portion of the web cleaning unit roller 61*b* is exposed from the left side plate 60*a* and is constituted so that the end portion is capable of engaging with a driving shaft of an unshown motor for winding up the web.

Further, inside the left side plate 60*a* of the cleaning unit 60, a remaining amount detecting arm 70 for detecting the remaining amount of the cleaning sheet 61 is supported rotatably via a shaft 70*d*. The remaining amount detecting arm 70 includes a lever 70*b* contacting the cleaning sheet 61 and a lever 70*a* interrelating the photo-interrupter with a remaining amount detecting flag described later.

An entirety of the above-described cleaning unit 60 is mounted at a predetermined mounting position between attitude control plates 90 and 90 positioned outside the left and right side plates 60*a* and 60*b*. In this embodiment, a locking mechanism for fixing or fixing-releasing the cleaning unit 60 in either of a locked state in which the cleaning unit 60 is fixed in this predetermined positional relationship or an unlocked state in which the cleaning unit 60 is fixing-released is provided. That is, on the top plate 60*c* of the cleaning unit 60, the dial-shaped web locking knob 73 capable of performing a rotation (movement) operation is provided, and with a lower surface of the web locking knob 73, one end of the locking arm 74 is linked. By performing the rotation operation of the web locking knob 73, free ends 74*a* and 74*b* of the locking arm 74 can be moved in an expansion and contraction direction shown by arrows in FIG. 12.

Figure 6:
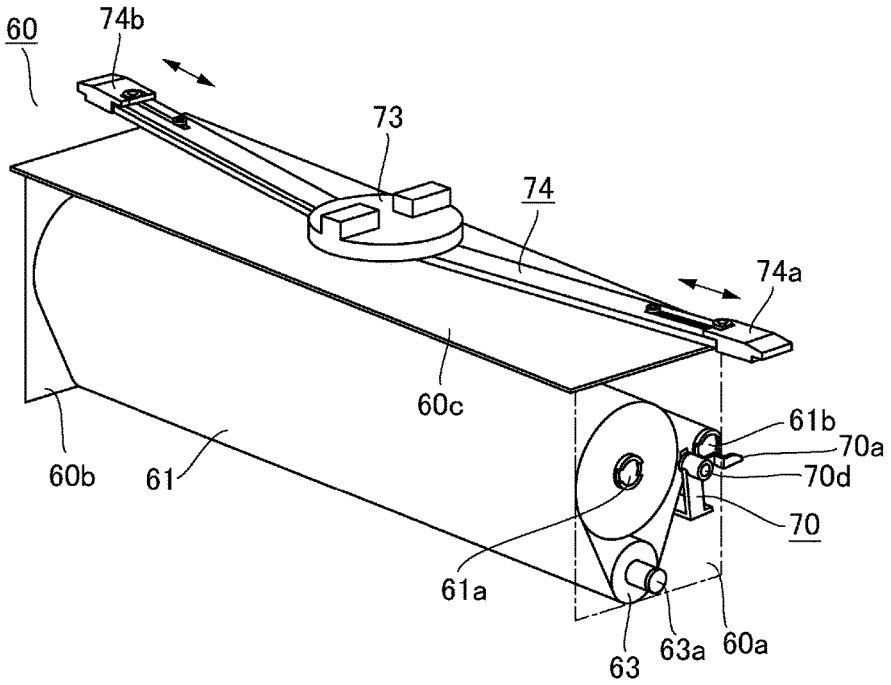
FIG. 6 is an illustration showing an unlocked state of the cleaning unit.

In the case where the web locking knob 73 is rotated (moved) to the position of FIG. 12, as shown in the figure and FIG. 6, the free ends 74*a* and 74*b* and outer locking holes 76*a* and 76*b*, having, e.g., a rectangular hole shape, provided in the attitude control plates 90 and 90. By this, the cleaning unit 60 is locked (fixed) at the predetermined mounting position in the cleaning device 600. Incidentally, in order to carry out positioning of the cleaning device 600 at the mounting position described above, for example, a guiding groove may also be provided, as desired, between the left and right side plates 60*a* and 60*b* and the attitude control plates 90 and 90. Further, the attitude control plates 90 and 90 in FIG. 12 are functionally displayed, and may also use a shape different from that in FIG. 12 in actuality (for example, FIG. 4 described later).

The attitude control plates 90 and 90 of the cleaning unit 60 are shaft-supported by the fixing device 9 via a unit rotation supporting portion 90*a*. The cleaning unit 60 may only be required to be constituted so that at least the cleaning unit 60 can be mounted and demounted as regards a purpose such as maintenance, and the attitude control plates 90 and 90 may only be required to be assembled with the fixing device 9 side with the above-described shaft-supporting relationship. In that meaning, the attitude control plates 90 and 90 may also be considered as, rather than a part of the cleaning device 600, a portion in the image forming mechanism (the fixing device 9 as an example of the heating device in this embodiment) side to which the cleaning unit 60 is mounted and from which the cleaning unit 60 is demounted.

In a normal image forming operation period, the cleaning unit 60 is put in the fixed (locked) state at the predetermined position (or with a predetermined positional relationship with the image forming mechanism) by the above-described locking arm 74. In this locked state, the attitude control plates 90 and 90 are swing (rotation)-operated by the controller (CPU 500) via the unit rotation supporting portion 90*a*. Depending on this, when the cleaning unit 60 is in a state in which the cleaning unit 60 is properly fixed (locked) by the attitude control plates 90 and 90, a portion acting on cleaning (portion) of the cleaning unit 60 is operated so as to be contacted to and spaced from an object-to-be-cleaned. A mechanism for swing (rotation)-operating the attitude control plates 90 and 90 is an operating cam 91 and a unit pressing spring 96 which are described later by FIG. 3. In FIG. 12, a direction in which the unit pressing spring 96 urges the attitude control plates 90 and 90 and an operating direction of the operating cam 91 are shown by arrows to which corresponding reference symbols (numerals) are added.

Figure 5:
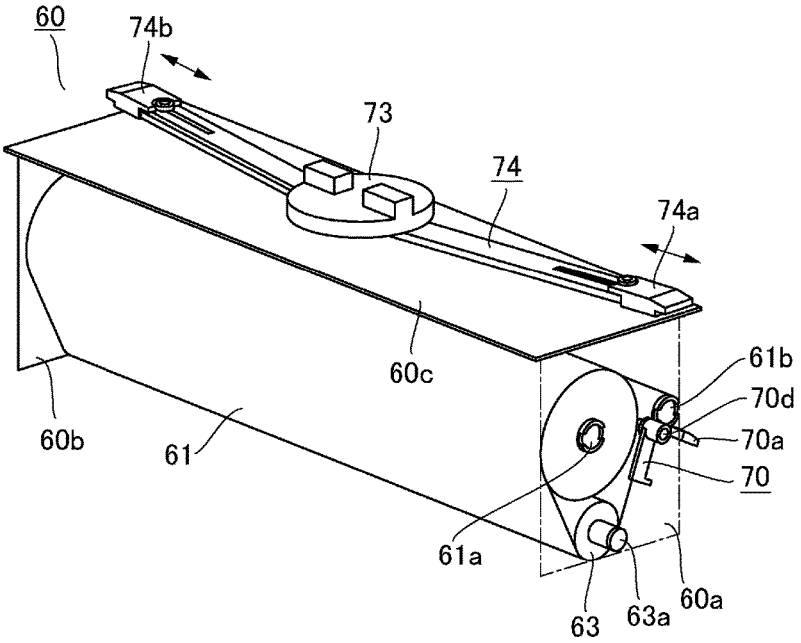
FIG. 5 is an illustration showing a locked state of the cleaning unit.

On the other hand, when the dial-shaped web locking knob 73 constituting the above-described locking mechanism is rotated as in, for example, FIG. 5, engagement between the free ends 74*a* and 74*b* of the locking arm 74 and the outer locking holes 76*a* and 76*b* (FIG. 12) is eliminated (disengaged). By this, the cleaning unit 60 is in the unlocked (fixing-released) state. In this unlocked (fixing-released) state, it becomes possible to perform a maintenance operation such that the cleaning unit 60 is demounted and the cleaning sheet 61 is exchanged or that the entirety of the cleaning unit 60 is exchanged as desired.

In this embodiment, the locking mechanism consisting of the web locking knob 73 and the locking arm 74 an the interrelating mechanism for interrelating the remaining amount detecting mechanism for detecting the remaining amount of the cleaning sheet 61. As regards this interrelating mechanism, description will be described later in detail, and in the following, by making reference to FIG. 3 and later, principally in the fixed (locked) state of the cleaning unit 60, a constitution and operation of the cleaning device 600 will be described.

Figure 3:
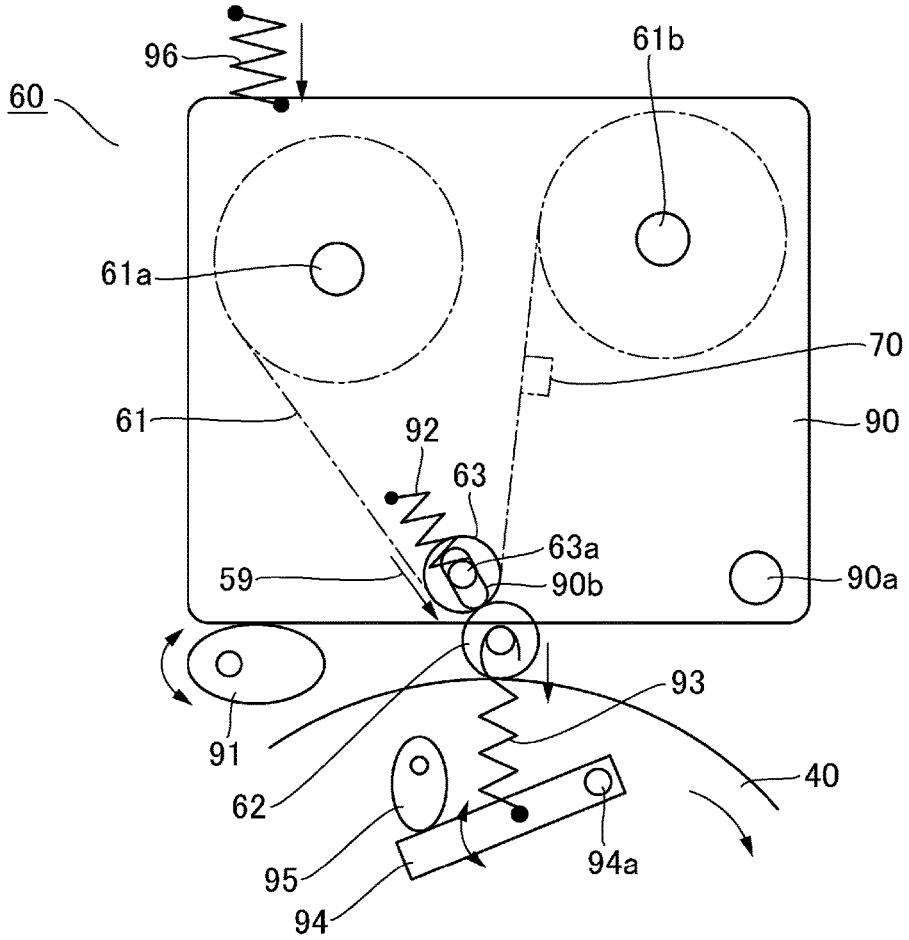
FIG. 3 is an illustration showing an example of a structure of a cleaning device provided together with the heating device of FIG. 2.
Figure 4:
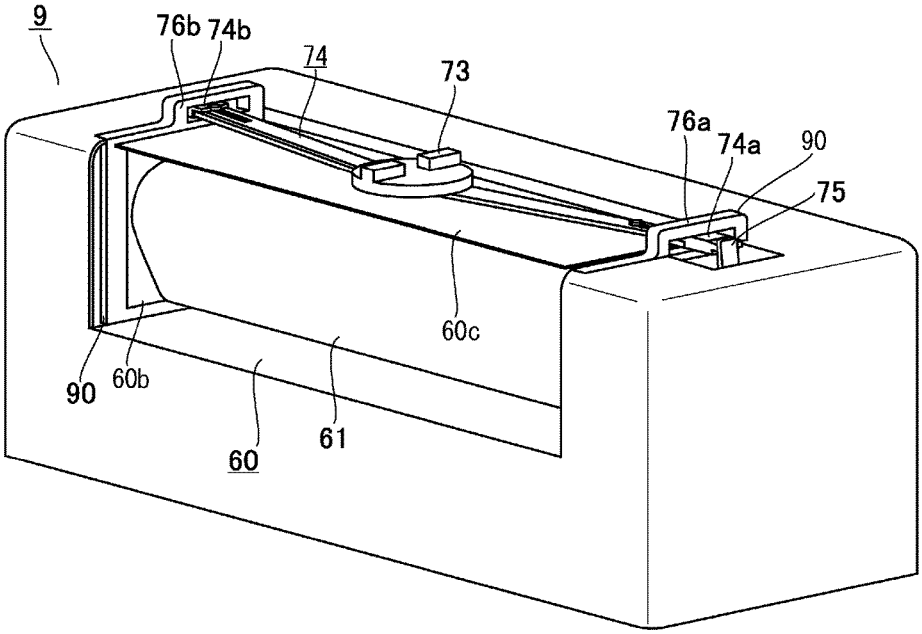
FIG. 4 is a perspective view showing a state in which a cleaning unit is mounted in the cleaning device in the image forming apparatus of FIG. 1.

FIG. 3 shows, from a side, a schematic structure of the cleaning device 600 in the fixed (locked) state of the cleaning unit 60. Further, FIG. 4 shows, as a perspective view, the entirety of the fixing device 9 being in the state in which the cleaning unit 60 of the cleaning device 600 is fixed (locked). The state of FIG. 4 is equal to the fixed (locked) state of the cleaning unit 60 shown in FIG. 12 described above, but portions around the outer locking holes 76*a* and 76*b* for the attitude control plates 90 and 90 can be formed in an annular shape as shown in, e.g., FIG. 4 as desired. Further, in FIG. 4, the unit pressing springs 96 and 96 for urging the attitude control plates 90 and 90 from above are not illustrated. However, the unit pressing springs 96 and 96 may employ an arbitrary structure such that the unit pressing springs 96 and 96 are appropriately disposed at an upper portion of the fixing device 9 or that the springs 96 and 96 are disposed inside the casing of the fixing device 9 and are disposed so as to press projections formed so as to extend to outsides of the attitude control plates 90 and 90, for example.

Here, a structure and a function of the cleaning device 600 will be described principally using FIG. 3. FIG. 3 shows a schematic structure of an upper surface of the fixing roller 40 of the fixing device 9 and the cleaning unit 60 positioned above the upper surface of the fixing roller 40. FIG. 3 schematically illustrates a state in which the cleaning unit 60 is fixed (locked) to the attitude control plates 90 and 90 by the above-described locking mechanism. For this reason, in FIG. 3, the left and right side plates 60*a* and 60*b*, the top plate 60*c* which are in the cleaning unit 60 side, and the web locking knob 73 and the locking arm 74 which are provided thereon, and the like are omitted from illustration.

In the illustrated state of FIG. 3, the cleaning sheet 61 contacts the collecting roller 62 via the web roller 63, and the fixing roller 40 is cleaned by the cleaning sheet 61 via the collecting roller 62 described above. An object to be collected and cleaned from the fixing roller 40 is, e.g., the offset toner transferred from the sheet P on the fixing roller 40 as described above.

The cleaning sheet 61 is charged in a state in which the cleaning sheet 61 is wound up by the web supplying roller 61*a* which is an example of a first winding-up member, and one end thereof is pulled out from an outside and is stretched and mounted so as to be wound up by the web cleaning unit roller 61*b* which is an example of a second winding-up member.

At an intermediary portion between the web supplying roller 61*a* and the web cleaning unit roller 61*b*, the cleaning sheet 61 is stretched and wound around the web roller 63 pressed toward the collecting roller 62 by a mechanism described later. The cleaning sheet 61 is pressed against the collecting roller 62 by the web roller 63 and cleans the collecting roller 62 (the fixing roller 40 via the collecting roller 62).

The cleaning sheet 61 is a cleaning web constituted by a material such as a nonwoven cloth, for example. The winding-up of the cleaning sheet 61 by the web cleaning unit roller 61*b* is carried out little by little (on a small amount basis), for example, by control of the CPU 500 (described later) in synchronism with the image forming process. The cleaning sheet 61 is pressed against the web roller 63 and cleans the collecting roller 62 while sliding on the collecting roller 62 at a portion thereof with respect to a movement direction.

Both ends of the web supplying roller 61*a*, the web cleaning unit roller 61*b* and the web roller 63 which are described above are shaft-supported by the left and right side plates 60*a* and 60*b* of the cleaning unit 60 as described above. A mechanism for urging and supporting the shaft 63*a* of the web roller 63 will be described later.

Further, as mentioned in FIG. 12, the (left and right (both) side) attitude control plates 90 constituting a part of the cleaning unit 60 are swing (rotation)-supported by the unit rotation supporting portion 90*a*. Further, the attitude control plates 90 are pressed by the unit pressing spring 96 from above in an opposite side from the unit rotation supporting portion 90*a*, and lower edges thereof are pressed against the operating cam 91. The operating cam 91 is disposed at a corresponding position of the inside of the fixing device 9, for example.

The control device, for example, the CPU 500 described above can switch the contact and separation (spacing) of the cleaning sheet 61 relative to the collecting roller 62 by rotation of the operating cam 91.

For example, at timing when cleaning of the fixing roller 40 after a single image forming process (fixing process) is needed, the CPU 500 lowers the attitude control plates 90 (and 90) via the operating cam 91 and can contact the web roller 63 to the collecting roller 62. In this state, by rotationally rotating the fixing roller 40, it is possible to remove the toner collected, from the fixing roller 40 on the collecting roller 62, by the cleaning sheet 61. Further, the CPU 500 actuates motor (not shown), included in the driven portion 506, at a frequency described later, so that the cleaning sheet 61 contacting the collecting roller 62 is gradually wound up, in an arrow 59 direction. As a result, before the cleaning sheet 61 is partly saturated with the toner, a fresh unused cleaning portion of the cleaning sheet 61 is contacted to the collecting roller 62, so that the fixing roller 40 can be cleaned via the collecting roller 62.

Further, during image formation, particularly in a period in which the fixing device 9 carries out an intended fixing process, the CPU 500 can raise the attitude control plates 90 (and 90) via the operating cam 91 as desired. By this, the influence on the image forming process can be reduced. Incidentally, a similar interrelating mechanism by the cam is also provided for the collecting roller 62.

A fresh (new) cleaning sheet 61 is mounted on the web supplying roller 61*a* in a roll state. A terminal portion of the cleaning sheet 61 is rotatable about the web supplying roller 61*a*, and a roll of the cleaning sheet 61 is rotated with pulling-out of the cleaning sheet 61. A starting portion of the cleaning sheet 61 engages with the web cleaning unit roller 61*b*. At one end portion of the web cleaning unit roller 61*b*, the motor (included in the above-described driven portion 506: not shown) for winding-up the cleaning sheet 61 is provided.

Here, description regarding materials or the like of respective portions constituting the cleaning device 600 will be described.

The web roller 63*a* is disposed with the shaft 63, as the center thereof, formed of a high-rigidity metal (SUS 303) in order to suppress flexure when contacting the collecting roller 62. In the web roller 63, on the shaft 63*a*, a silicone sponge which is easily flexed and which has a heat-resistant property and a diameter of 30 mm is wound in order to enhance a broad nip width with the collecting roller 62 to enhance cleaning power. Further, it is possible to prevent toner deposition by coating the surface of the silicone sponge with a 100 μm-thick PFA tube.

The shaft 63*a* of the web roller 63 is supported rotatably and slidably in an elongated hole 90*b* provided in the attitude control plate 90. A sliding direction in the elongated hole 90*b* is a direction perpendicular to a tangential line between the web roller 63 and the collecting roller 62. The shaft 63*a* of the web roller 63 is pressed in a direction of the collecting roller 62 by a web roller pressing spring 92 elastically mounted between pins (not shown) provided on the attitude control plate 90, for example. An arrangement position of the web roller pressing spring 92 is not illustrated also in other figures in detail, but may be provided either outside or inside the attitude control plate 90.

The collecting roller 62 is a cylindrical member formed of SUS 303 in an outer diameter of 20 mm. In the case where the toner is scraped off from the sheet P to effect onto the fixing roller 40, an offset toner is collected by the cleaning sheet 61 after being collected by the collecting roller 62. The collecting roller 62 is disposed so as to be always contacted to the surface of the fixing roller 40 also, e.g., in a period other than during image formation for the purpose of collecting a deposited matter.

The collecting roller 62 is rotated by the fixing roller 40 with rotation of the fixing roller 40. The collecting roller 62 is rotatable by being supported at both end portions by ball bearings supported movably in a direction of the fixing roller 40.

The collecting roller 62 is pressed toward the fixing roller 40 by a collecting roller pressing spring 93, a collecting roller pressing arm 94 and a collecting roller pressing cam 95. The collecting roller pressing spring 93 is fixed at one end to the end portion of the collecting roller 62, and the collecting roller pressing spring 93 is fixed at the other end to the collecting roller pressing arm 94. The control device, for example, the CPU 500 causes the collecting roller pressing cam 95 to rotate, whereby the collecting roller pressing arm 94 is rotated about a rotation shaft 94*a*, so that an operating length of the collecting roller pressing spring 93 can be changed.

By this, the CPU 500 can variably change a pressure of the collecting roller 62 to the fixing roller 40. A variable range of the pressure of the collecting roller 62 to the fixing roller 40 is about 0 N to 80 N, for example. The CPU 500 is capable of variably controlling the pressure of the collecting roller 62 to a proper value depending on the image forming sequence or the cleaning operation by the cleaning device 600 described above.

For example, in a period in which the cleaning operation is not needed, the CPU 500 controls the pressure so that the pressure of the collecting roller 62 is made a weak value (e.g., in the neighborhood of 0 N) in the above-described variable pressure range by the collecting roller pressing cam 95, in synchronism with the raising of the attitude control plates 90 (and 90). Further, at timing when the cleaning operation is performed, the CPU 500 controls the pressure so that the pressure of the collecting roller 62 is made a weak value (e.g., in the neighborhood of 80 N) in the above-described variable pressure range by the collecting roller pressing cam 95, in synchronism with the lowering of the attitude control plates 90 (and 90). Incidentally, the pressure control, of the collecting roller 62, carried out via the collecting roller pressing cam 95 is not necessarily carried out in the mode as described above, and the person skilled in the art may change arbitrarily as needed.

(Cleaning Sheet Remaining Amount Detection)

Here, a mechanism for remaining amount detection in which a remaining amount of the cleaning sheet 61 of the cleaning device 600 is detected will be described. The position, where the remaining amount detecting arm 70 contacts the cleaning sheet 61, described in FIG. 12 is shown by the same reference symbol in FIG. 3 (ditto for FIG. 2).

Figure 7:
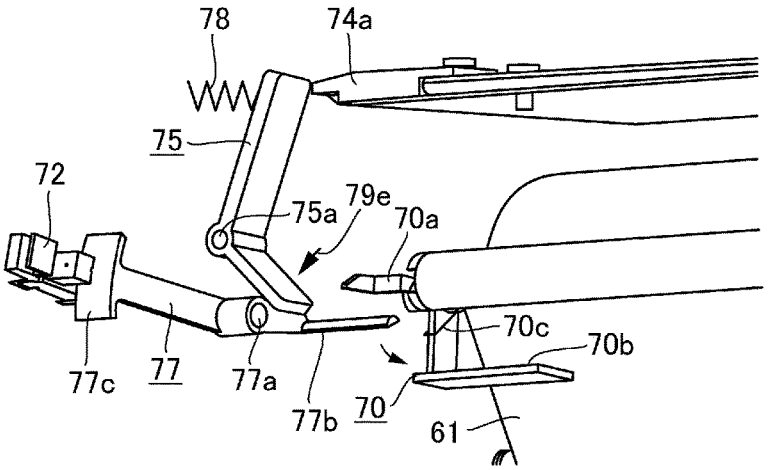
FIG. 7 is a perspective view showing a state of respective portions in the unlocked state of the cleaning unit.
Figure 8:
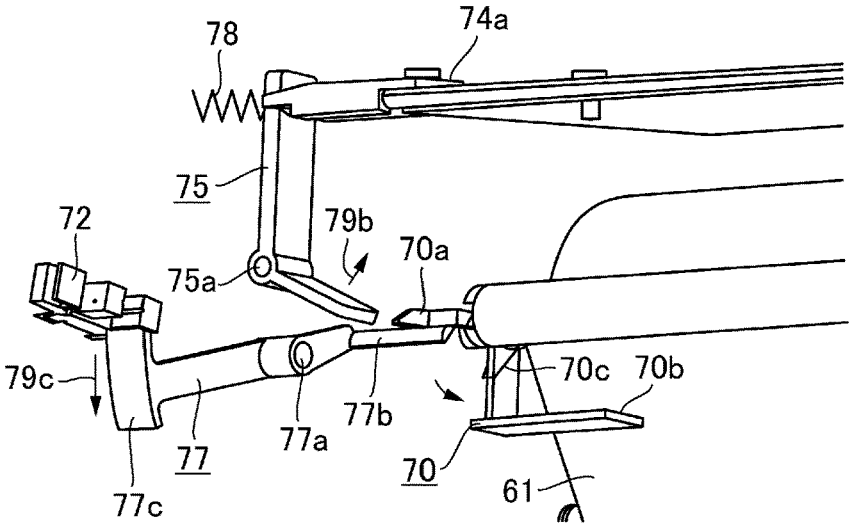
FIG. 8 is a perspective view showing a state of the respective portions in the locked state of the cleaning unit.
Figure 9:
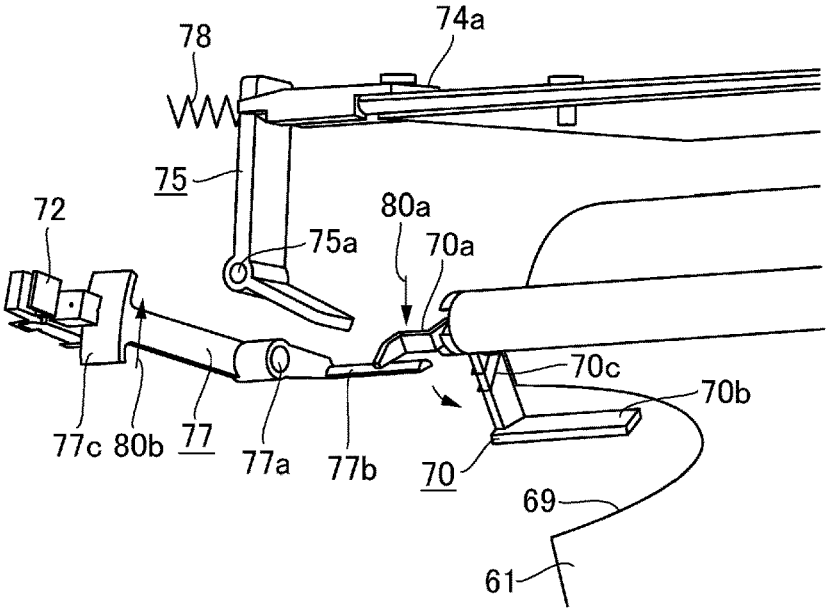
FIG. 9 is a perspective view showing a detection state of a small remaining amount of a cleaning sheet in the locked state of the cleaning unit.

FIGS. 7 to 9 show an example of a structure of a remaining amount detecting mechanism including the remaining amount detecting arm 70. FIGS. 7 to 9 show, as perspective views from a rear side (from a right side of FIGS. 3 and 2), a structure around the remaining amount detecting arm 70 shown in FIGS. 12, 5 and 6 and the like.

In this embodiment, the control device, for example, the CPU 500 causes the cleaning sheet 61 to move in a movement direction by a predetermined amount for each of times of image formation on a predetermined number of recording material sheets and carries out control so that the cleaning sheet 61 is wound up gradually in a direction of the arrow 59 (FIG. 3). Specifically, a web feeding amount per (one) sheet P of A4 in size fed by long edge feeding is about 0.5 mm/sheet, for example. Or, control such that the cleaning sheet 61 is sent by about 5 mm for each image formation on 10 sheets.

At a portion, in the neighborhood of an end edge of the cleaning sheet 61, where a small remaining amount should be detected, a cut-away portion 69 is provided as shown in FIG. 9. The remaining amount detecting arm 70 supported rotatably around the shaft 70*d* is rotationally urged in arrow directions of FIGS. 7 to 9 by a spring 70*c*.

For this reason, in a state in which there is a sufficient remaining amount of the cleaning sheet 61, the lever 70*b* contacts the cleaning sheet 61 and the remaining amount detecting arm 70 assumes an attitude as in FIG. 8 (or ditto for FIG. 7). On the other hand, when the cleaning sheet 61 is consumed by the above-described feeding of the cleaning sheet 61 and the cut-away portion 69 reaches the position of the lever 70*b*, the remaining amount detecting arm 70 assumes an attitude as in FIG. 9.

In order to read a detection state of the remaining amount detecting arm 70 as described above via the photo-sensor 72 provided as a remaining amount sensor for detecting the remaining amount of the cleaning sheet 61, in this embodiment, a mechanism as described below is provided, for example. The lever 70*a* of the remaining amount detecting arm 70 of the cleaning unit 60 shown in FIGS. 7 to 9 is provided, as shown in FIGS. 12, 5 and 6 and the like, so as to project to a position behind the left side plate 60*a*.

On the other hand, in the image forming apparatus 100 (i.e., the fixing device 9 as the image heating apparatus) side, a the photo-interrupter 77 shaft-supported by a rotation shaft 77*a* is provided. The photo-interrupter 77 includes, at one end of the rotation shaft 77*a*, a lever 77*b* engageable with the lever 70*a* of the remaining amount detecting arm 70 and includes, at a free end of the other end of the rotation shaft 77*a*, a light-block portion 77*c* having an arcuate cross-section. The photo-interrupter 77 is constituted so that a portion thereof in the light-block portion 77*c* side is heavier than a portion thereof in the lever 77*b* side with respect to, e.g., the rotation shaft 77*a*, as a center (the center of gravity is positioned at the portion in the light-block portion 77*c* side). Such a constitution can be realized by adjusting a length and a material of the portions of the photo-interrupter 77 in both sides of the rotation shaft 77*a*. By such an arrangement of the center of gravity, the photo-interrupter 77 is displaced so as to assume an attitude following an engaged state of the lever 77*b* with the lever 70*a* of the remaining amount detecting arm 70.

Further, in the image forming apparatus 100 (i.e., the fixing device 9 as the image heating apparatus) side, the photo-sensor 72 for detecting the light-block portion 77*c* is provided. The photo-sensor 72 is constituted by, e.g., a photo-interrupter including a light projecting portion and a light receiving portion and is capable of detecting whether or not the light-block portion 77*c* is positioned between the light projecting portion and the light receiving portion. The detection state of the photo-sensor 72 can be read by the CPU 500 via the interface 503.

When the remaining amount of the cleaning sheet 61 becomes small and the cut-away portion 69 appears at the position of the lever 70*b* of the remaining amount detecting arm 70, as shown in FIG. 9, the remaining amount detecting arm 70 is rotated as in an arrow by an urging force of the spring 70*c*. By this, the lever 70*a* of the remaining amount detecting arm 70 engages with the lever 77*b* of the remaining amount detecting arm 77 and pushes down the lever 77*b* as in an arrow 80*a*. By this, the photo-interrupter 77 is rotated as in an arrow 80*b*, so that the light-block portion 77*c* moves to a position where the light-block portion 77*c* blocks detection light of the photo-sensor 72. This detection state of the photo-sensor 72 is referred to as a light-blocked state (ON) in this embodiment.

On the other hand, in the case where the remaining amount of the cleaning sheet 61 is sufficient, the remaining amount detecting arm 70 is in a state of FIG. 8. In this case, the lever 70*b* of the remaining amount detecting arm 70 urged by the spring 70*c* contacts the cleaning sheet 61 and does not rotate to the extent of the state of FIG. 9. For this reason, depending on the rotation position of the lever 70*a* of the remaining amount detecting arm 70, the lever 77*b* of the photo-interrupter 77 is rotated as in an arrow 79*c*, so that the light-block portion 77*c* leaves the position of the photo-sensor 72. For this reason, a state in which the detection light of the photo-sensor 72 is not blocked by the light-block portion 77*c* is formed. This detection state of the photo-sensor 72 is referred to as a light-transmitted state (OFF).

The CPU 500 reads an output state of the detection signal of the photo-sensor 72 via the interface 503 and can recognize a state of the remaining amount of the cleaning sheet 61 through the light-blocked state (ON) or the light-transmitted state (OFF) which are described above. According to the above-described constitution of the remaining amount detecting means, when the detection signal of the photo-sensor 72 indicates the light-blocked state, the cut-away portion 69 of the cleaning sheet 61 is detected, so that the remaining amount of the cleaning sheet 61 can be discriminated as being small. Further, when the detection signal of the photo-sensor 72 indicates the light-transmitted state (OFF), the cut-away portion 69 is not detected, so that the remaining amount of the cleaning sheet 61 can be discriminated as being still sufficient.

However, in this embodiment, the photo-sensor 72 is used for detecting also a locked/unlocked state of the cleaning unit 60 through an operation of an interrelating mechanism, for interrelating the locking mechanism of the cleaning unit 60 with the above-described remaining amount detecting means, described later. For this reason, in this embodiment, as shown in a control procedure (FIGS. 10 and 11) described later, control for changing interpretation (discrimination) of the output state of the photo-sensor 72 is changed depending on detection timing, for example.

Incidentally, a distance from a starting end of the cleaning sheet 61 wound and mounted about the web supplying roller 61*a* to the cut-away portion 69 is, e.g., about 5000 mm. Further, in order that a necessary cleaning operation is performed depending on image formation on a single sheet P and that a cleaning portion acting on the cleaning with the cleaning operation is moved, a feeding amount of the cleaning sheet 61 wound up by the cleaning unit roller 61*b* is about 0.5 mm/sheet, for example. In such a dimensional distribution, after the cleaning sheet 61 is exchanged to a new one, when about 10000 sheets P are subjected to sheet passing (image formation), the cut-away portion 69 appears at the position of the remaining amount detecting arm 70, and by this, a small remaining amount is detected through the light-blocked state (ON) of the photo-sensor 72. Further, a length of a portion subsequent to the cut-away portion 69 wound and mounted about the web supplying roller 61*a* is about 75 mm, for example. In this dimensional distribution, when the feeding amount per (one) sheet (one image formation) is 0.5 mm sheet, even after the cut-away portion 69 is detected, it is possible to execute cleaning necessary for image formation on about 150 sheets P.

(Detection of Locked State of Cleaning Unit)

Then, in either of FIGS. 8 and 9, a proper mounting state in which the (free end of the) locking arm 74 engages with the outer locking hole 76*a* and the cleaning unit 60 is locked by the attitude control plates 90 and 90 is formed (state of FIG. 12, 6 or 4). In this embodiment, in the case where the cleaning unit 60 is thus in the proper mounting state in which the cleaning unit 60 is locked by the attitude control plates 90 and 90, by the operation as described above, the CPU 500 is capable of carrying out image formation control depending on the remaining amount of the cleaning sheet 61.

However, after an operation such as mounting and demounting of the cleaning unit 60 described later, in the case where the above-described locking (fixing) operation is erroneously performed and the locked state is not formed (or is insufficient), the cleaning unit 60 cannot be properly operated. For example, in a (unlocked) state in which the cleaning unit 60 is not locked by the attitude control plates 90 and 90, even when the CPU 500 operates the attitude control plates 90 and 90 via the operating cam 91, the cleaning unit 60 does not operate as design intent. By this, an intended cleaning operation becomes impossible, so that there is a possibility that image defect generates.

For this reason, in this embodiment, as shown at upper portions of FIGS. 7 to 9, an interrelating mechanism for interrelating the locking mechanism consisting of the web locking knob 73, the locking arm 74 and the like with the remaining amount detecting means consisting of the photo-interrupter 77, the photo-sensor 72 and the like is provided.

This interrelating mechanism includes interrelating arms 75 provided above the photo-interrupter 77 in the fixing device 9 side. An upper portion of the interrelating arms 75 is shown in FIG. 4, and the interrelating arms 75 are disposed outside the attitude control plates 90 and 90 (and the outer locking holes 76*a* and 76*b*) as in the figure.

As shown in FIGS. 7 to 9, the interrelating arm 75 has a substantially L-(character) shape and is shaft-supported rotatably about a rotation shaft 75*a*. The upper portion of the interrelating arm 75 is not only urged rightward in FIGS. 7 to 9 by a spring 78 elastically mounted between itself and a predetermined portion in the fixing device 9 but also has a length in which the upper portion is engageable with a free end 74*a* of the locking arm 74. Incidentally, a spring force of the spring 78 is set at about 200 gf, for example.

By this, the interrelating arm 75 interrelates with the free end 74*a* of the locking arm 74 and is controlled to an attitude of FIG. 7 or FIG. 8 (and FIG. 9) depending on an interrelating state with the locking arm 74. FIG. 7 corresponds to an unlocked (fixing-released) state of the cleaning unit 60 in which the free end 74*a* of the outer locking arm 74 is recessed inwardly from the locking hole 76*a*. Further, FIG. 8 and FIG. 9 correspond to a locked (fixed) state of the cleaning unit 60 in which the free end 74*a* of the outer locking arm 74 projects to an outside of the locking hole 76*a* and engages with the interrelating arm 75.

Here, in the locked (fixed) state (FIGS. 8 and 9) of the cleaning unit 60, the locking arm 74 is pushed and rotated counterclockwisely in the figure (arrow 79*b* in FIG. 8) by the free end 74*a* of the locking arm 74 and does not obstruct the operation of the photo-interrupter 77. Accordingly, in the locked (fixed) state (FIGS. 8 and 9) of the cleaning unit 60, the photo-interrupter assumes, as described above, the attitude corresponding to FIG. 8 (with a remaining amount) or FIG. 9 (with a small remaining amount) depending on the remaining amount of the cleaning sheet 61. Accordingly, in this locked (fixed) state of the cleaning unit 60, the CPU 500 is capable of detecting the remaining amount of the cleaning sheet 61 through the light-blocked state (ON) or the light-transmitted state (OFF) of the photo-sensor 72.

On the other hand, in the unlocked (fixing-released) state (FIG. 7) of the cleaning unit 60, the urging (pressing) of the free end 74*a* of the locking arm 74 against the interrelating arm 75 is eliminated (released), so that the interrelating arm 75 rotates clockwisely in the figure (arrow 79*e*). For this reason, the lever 77*b* of the photo-interrupter 77 which is pressed down by a lower portion of the interrelating arm 75 forcedly controls the photo-sensor 72 so as to be in the light-blocked state (ON). In this embodiment, it is possible to detect the unlocked (fixing-released) state of the cleaning unit 60 through the light-blocked state (ON), of the photo-sensor 72, formed by the interrelating operation as in FIG. 7.

Detection control of the locked state of the cleaning unit 60 by using the interrelating mechanism (interrelating portion, acting portion) shown in FIG. 7 and FIG. 8 (FIG. 9) will be described later in detail using a flowchart (particularly FIG. 10)

(Mounting and Demounting of Cleaning Unit)

Here, exchange or mounting and demounting of the cleaning unit 60 of the cleaning device 600 will be described. FIG. 4 shows, as a perspective view, a state in which the cleaning unit 60 of the cleaning device 600 is mounted in the fixing device 9. As described above, the cleaning unit 60 includes the locking mechanism consisting principally of the web locking knob 73 and the locking arm 74.

For example, when the web locking knob 73 is rotated to a rotation position of FIG. 6, in interrelation with this, the free ends 74*a* and 74*b* of the locking arm 74 extend and engage with the outer locking hole 76*a* and 76*b* of the attitude control plates 90 and 90 swing-supported in the fixing device 9 side (FIGS. 8, 9 and 12). Thus, the cleaning unit 60 is locked (fixed) to the image forming mechanism (the fixing device 9 as the image heating apparatus). When the web locking knob 73 is rotated from this state to a rotation position of FIG. 5, engagement of the free ends 74*a* and 74*b* of the locking arm 74 with the outer locking holes 76*a* and 76*b* is eliminated (disengaged), so that the cleaning unit 60 is unlocked (fixing-released).

In the unlocked (locking-released) state of the cleaning unit 60, the cleaning unit 60 can be pulled out, e.g., upwardly from between the attitude control plates 90 and 90. Thereafter, a fresh (new) cleaning unit 60 (for example, supplied as an exchanging or maintenance part) is mounted, and again, the cleaning unit 60 is locked by the above-described operation of the web locking knob 73. By this, the cleaning operation as design specification of the cleaning unit 60 becomes possible. Incidentally, not the exchange for each of cleaning units 60, a maintenance type in which the consumed cleaning sheet 61 is removed from the cleaning unit 60 and is exchanged with a fresh (new) cleaning sheet 61 may also be employed.

In the locked state of the cleaning unit 60 by the attitude control plates 90 and 90, the attitude control of the cleaning unit 60 described in FIG. 3 becomes possible, so that it is possible to carry out the cleaning operation as design specification. In that case, the remaining amount detecting mechanism of the cleaning sheet 61 operates as shown in FIGS. 8 and 9, and in the case where the cleaning sheet 61 becomes small in remaining amount, the CPU 500 of the control system can detect the state as the light-blocked state (ON) of the photo-sensor 72. In this case, for example, as shown in control described later, an image process is permitted in number of times in which the cleaning process can be performed at a portion subsequent to the cut-away portion 69 of the above-described cleaning sheet 61 while providing warning to the effect that the remaining amount of the cleaning sheet 61 is small. Or, in a simple control specification, in the case where the small remaining amount of the cleaning sheet 61 is detected as described above, the CPU 500 immediately carries out control so as to prohibit further image formation (sheet passing).

On the other hand, in the case where the cleaning unit 60 is in the unlocked (unfixed) state (or ditto for a state in which the cleaning unit 60 is demounted from the cleaning device 600), the interrelating mechanism of the locking mechanism of the cleaning sheet 61 with the remaining amount detecting mechanism is in the state of FIG. 7. In this state of FIG. 7, naturally, the attitude control of the cleaning unit 60 described in FIG. 3 is impossible, and the cleaning operation as design specification is impossible, so that if the image formation is forcedly carried out, there is a possibility that an image defect generates.

However, in this embodiment, in the state of FIG. 7, the light-blocked state (ON) of the photo-sensor 72 is forcedly formed through the interrelation of the interrelating arm 75 with the photo-interrupter 77 irrespective of the remaining amount of the cleaning sheet 61. In the case where the small remaining amount of the cleaning sheet 61 is detected, when control specification in which the CPU 500 immediately prohibits the image formation (sheet passing), further additional mechanism and control are not needed, and the image formation (sheet passing) can be prohibited in this state. Accordingly, it is possible to reliably avoid a problem such as a lowering in recording image quality due to improper cleaning of the heating member (fixing roller 40).

Figure 10:
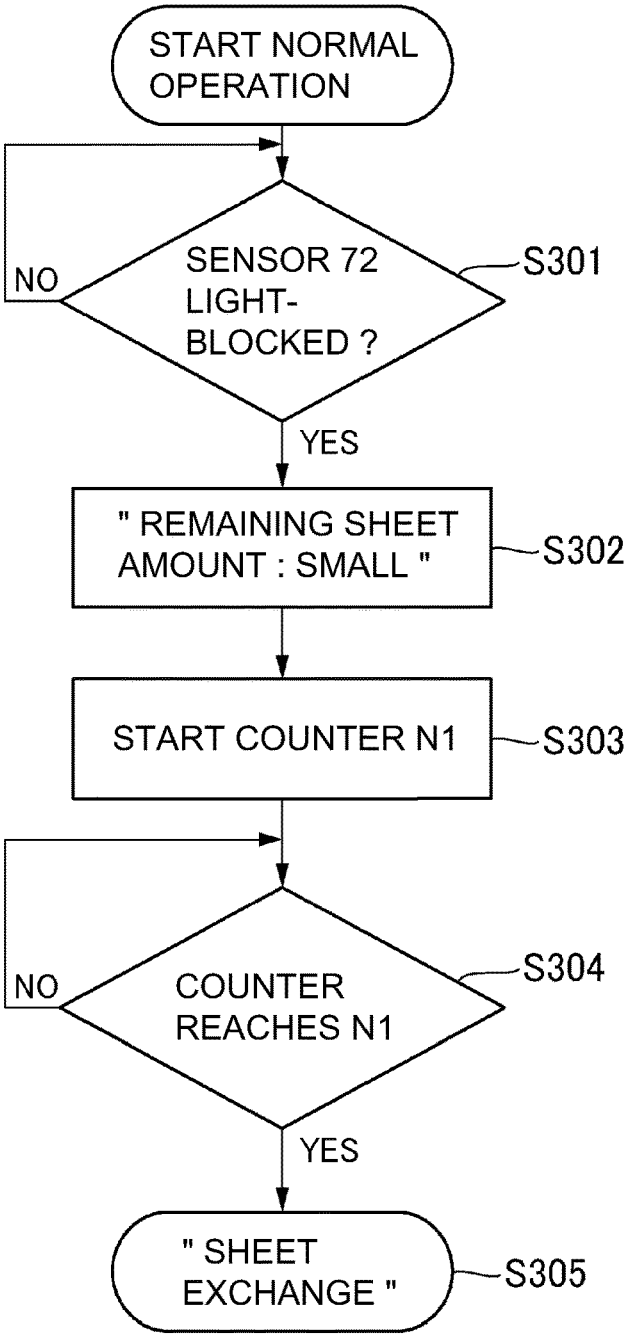
FIG. 10 is a flowchart showing control of the cleaning device during a normal operation of the image forming apparatus.
Figure 11:
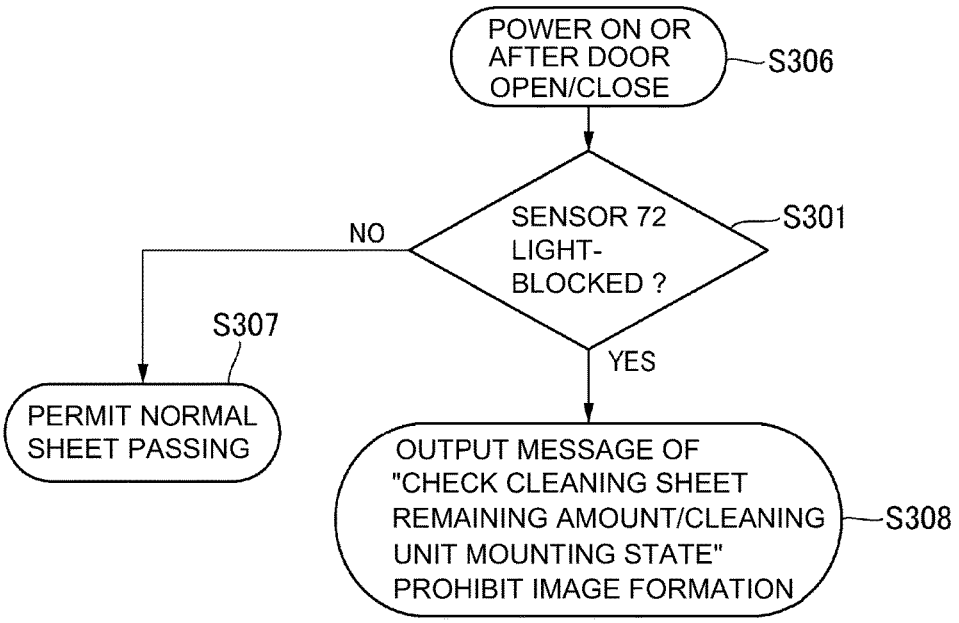
FIG. 11 is a flowchart showing control of the cleaning device in an initial state such as main switch actuation of the image forming apparatus or after a door is opened or closed.

Or, in the control specification in which the image formation effected in the number of times in which the cleaning process can be performed at the portion subsequent to the cut-away portion 69 of the cleaning sheet 61 is permitted as described above, separation and division of the control as shown in FIGS. 10 and 11 described later are carried out. By effecting the control as shown in FIGS. 10 and 11 described later, it is possible to properly carry out an output of warning information and prohibition (or permission) of image formation.

As described above, according to this embodiment, the interrelating mechanism for interrelating the locking mechanism of the cleaning unit 60 with the photo-interrupter 77 displaced depending on the remaining amount of the cleaning sheet 61 is provided. This interrelating mechanism causes the photo-sensor 72 as a remaining amount sensor to output the detection signal indicating the small remaining amount state of the cleaning sheet 61 in the unlocked state of the cleaning unit 60 or an unmounted state of the cleaning unit 60 in the cleaning device 600. Further, in the locked state of the cleaning unit 60, the interrelating mechanism causes the photo-sensor 72 to output the detection signal indicating the remaining amount of the cleaning sheet 61 detected via the photo-interrupter displaced depending on the remaining amount of the cleaning sheet 61.

Accordingly, the image formation (sheet passing) can be permitted in the case where the cleaning unit 60 is normally mounted and is in locked (fixed) state and only in a state in which there is a sufficient remaining amount. By this, a lowering in image quality (or a breakdown of the mechanism) generating in the case where the cleaning unit 60 is not normally mounted due to an operation error of a user or the like can be prevented, so that an image forming performance with a high image quality can be maintained with the cleaning process as design specification.

Further, according to this embodiment, the photo-sensor 72 can be used for both of the remaining amount detection of the cleaning sheet 61 and the detection of the locked (fixed) state of the cleaning unit 60. For this reason, it is possible to simplify the control circuit and to reduce the number of circuit parts, so that it is possible to realize space saving of the image forming apparatus 100 by a simple and inexpensive constitution.

(Control Example Relating to Cleaning Unit)

In the control specification in which the image formation effected in the number of times in which the cleaning process can be performed at the portion subsequent to the cut-away portion 69 of the cleaning sheet 61 is permitted, the control as shown in FIGS. 10 and 11 described later is carried out. In this case, separation and division of the control as described below are carried out between after a main switch of the image forming apparatus 100 is turned on and after the opening and closing of the door 81 detected by the sensor 82 (FIG. 11) and the normal image forming period other than it (FIG. 10). By this, even in a constitution in which only a single photo-sensor 72 as described above is used, it is possible to combine the remaining amount detection of the cleaning sheet 61 with the detection of the locked (fixed) state of the cleaning sheet 61 with improved appearance.

FIGS. 10 and 11 show a control procedure of the image forming apparatus 100 executed by the CPU 500 as the control device, for example. The illustrated procedure in the figure can be described as a control program to be executed by the CPU 500, and the control program is stored in advance in, e.g., the ROM 501 or the external storing device 504.

FIG. 10 shows the control in an operation (normal operation) period in which a normal image forming process is carried out. Incidentally, this normal operation period of FIG. 10 is not started until in the control carried out after the main switch of the image forming apparatus 100 is turned on and after the opening and closing of the door 81 detected by the sensor 82, image formation permission is made (S307 in FIG. 11).

In the normal operation period, the locked (fixed) state of the cleaning unit 60 has already been confirmed by the control of FIG. 11 described later, and as described in FIGS. 8 and 9, the CPU 500 can detect the remaining amount of the cleaning sheet 61 by the output of the photo-sensor 72.

In the normal operation period of FIG. 10, when the photo-sensor 72 changes from the light-transmitted state to the light-blocked state (ON) (YES of step S301), for example, "Warning of small cleaning web remaining amount" is outputted by a display device of the operating panel 505 or by a voice outputting device (step S302). This "Warning of small cleaning web remaining amount" is a warning message such that, e.g., "Cleaning sheet 61 is used up soon", and is outputted from the operating panel 505 by way of character display, synthesized voice or the like.

Subsequently, a counter provided in a nonvolatile (EEP) ROM region provided at a part of, e.g., the RAM 502 or the ROM 501 is started (step S303). In this embodiment, (also) after the small remaining amount state of the cleaning sheet 61 is detected, the control is carried out so that a predetermined number of times of the image formation is permitted, but this counter is used for counting the number of times of the image formation up to the predetermined number of times (count upper-limit threshold). As regards this counter, the CPU 500 increments the counter one by one every image formation on a single sheet, and the count upper-limit threshold can be about 150 (sheets or times) when a value corresponding to a dimension of the cleaning sheet 61 subsequent to the above-described cut-away portion 69 is employed. In this embodiment, as the count upper-limit threshold, 100 (sheets or times) allowing the counter leeway than 150 (sheets or times).

The normal image formation control is executed in a loop period of step S304, but during the period, the CPU 500 appropriately outputs the warning message of the above-described step S302. Then, the light-blocked state of the photo-sensor 72 continues, and therefore when the counter started in the step S303 reaches the above-described upper-limit threshold (100 sheets or times), transfer to step S305 generates. In the step S305, the CPU 500 causes the operating panel to display "Cleaning web exchange instruction" and stops further image formation (step S305).

On the other hand, the CPU 500 carries out control as in FIG. 11 in initialization after the main switch of the image forming apparatus 100 is turned on and after the opening and closing of the door 81 detected by the sensor 82 (FIG. 11).

For example, when "Warning of small web remaining amount" or "Web exchange instruction" is displayed by the control of FIG. 10, the user (or service person) performs exchange (mounting and demounting) operation of the cleaning unit 60 depending on this display. The control of FIG. 11 is effected by the purpose of discriminating whether or not in this exchange (mounting and demounting) operation of the cleaning unit 60, the cleaning unit 60 is properly exchanged with a new one and the mounting of the cleaning unit 60 is performed with reliability.

Here, when the cleaning unit 60 is demounted, it is general rule that the demounting is performed after the door 81 is opened and closed and the fixing device 9 is pulled out or after the main switch of the apparatus is turned off. Accordingly, the control of FIG. 11 is executed in initialization after the main switch of the image forming apparatus 100 is turned on or after the opening and closing of the door 81 detected by the sensor 82.

In step S306 of FIG. 11, when the CPU 500 detects a phenomenon such as the initialization after the main switch of the image forming apparatus 100 is turned on or the detection of the opening and closing of the door 81 by the sensor 82 (step S306), the following control is carried out.

First, the output state of the photo-sensor 72 is checked (step S301) and when the photo-sensor 72 is in the light-transmitted state (OFF), the procedure goes to step S307 and the image formation is permitted. By this, the control of the image forming apparatus 100 can go to the normal operation control shown in FIG. 10.

On the other hand, in the step S301, in the case where the photo-sensor 72 is in the light-blocked state (ON), the CPU 500 discriminates that at least the cleaning unit 60 is not in a proper state and immediately prohibits the image forming process in step S308. Incidentally, in the case where the photo-sensor 72 is in this detection state, according to the constitutions (FIG. 7 to FIG. 9) of the above-described interrelating mechanism, the case where the cleaning unit 60 is unlocked (is in an unmounted state or is not in a normal mounted state) is included. Further, also the case where the cleaning unit 60 is in the locked state and the remaining amount of the cleaning sheet 61 is small is included.

Therefore, in the case where the image forming process is immediately prohibited in the step S308, the warning message such that, for example, "Check remaining amount of cleaning sheet or check mounted state of cleaning sheet" is outputted from the operating panel 505. That is, both of discrimination that the locking mechanism is in the unlocked state and discrimination that the remaining amount of the cleaning sheet is small are outputted as the warning message.

By carrying out the control as in FIGS. 10 and 11, the cleaning unit 60 can be properly mounted while employing the control specification in which the image formation in the number of times in which the cleaning process can be performed at the portion subsequent to the cut-away portion 69 of the cleaning sheet 61 is permitted. Particularly, at timing of during the turning-on of the main switch or after the opening and closing of the door 81 of the image forming apparatus 100, a constitution in which the mounting state of the cleaning unit 60 can be checked using the remaining amount detecting means of the cleaning sheet 61 via the interrelating mechanism is employed. At this timing, in advance of the normal operation, of during the turning-on of the main switch or after the opening and closing of the door 81 of the image forming apparatus 100, when the cleaning unit 60 is in the unlocked state, the warning message to the effect thereof is generated, so that the cleaning unit 60 can be locked with reliability.

Further, in this embodiment, the image formation can be carried out using a remaining portion of the cleaning sheet 61 while outputting a proper warning message depending on the small remaining amount of the cleaning sheet 61. By this, the portion capable of being used for cleaning the cleaning sheet 61 can be used efficiently. Further, in this embodiment, the warning message is outputted at timing such that the image formation effected in the number of predetermined times from the detection of the small remaining amount of the cleaning sheet 61 is permitted. For this reason, the user (or an administrator or the service person) can prepare for the exchange of the cleaning sheet 61 or the cleaning unit 60 with time. On the other hand, when the cleaning unit 60 is not properly mounted or the remaining amount of the cleaning sheet 61 is 0, the image formation can be prohibited, so that a problem such that image quality lowering generates due to improper cleaning can be avoided with reliability.

Incidentally, in the above, roughly two types of control were considered as the control in the case where the photo-sensor 72 for detecting the cut-away portion 69 of the cleaning sheet 61 via the photo-interrupter 77 generates a detection sensor corresponding to (comparable to) the remaining amount warning. Of these, first control permits the image forming operation (sheet passing) in the number of times in which the cleaning process can be performed at the portion subsequent to the cut-away portion 69 of the cleaning sheet 61 while outputting the warning message (to the effect that the remaining amount is small) as shown in the above-described FIG. 10. Further, second control prohibits further image forming operation (sheet passing) in the case where the small remaining amount of the cleaning sheet 61 is detected as mentioned above.

However, the above-described first and second (two) control modes are not carried out particularly only exclusively, but for example, it is possible to carry out both of the control modes by providing a plurality of cut-away portions 69 at different positions of the cleaning sheet 61. For example, a first cut-away portion 69 is provided at a position corresponding to a remaining amount in which cleaning relating to image formation on about 100 sheets (times), described in association with FIG. 10, from an end edge of the cleaning sheet 61. Further, a second cut-away portion 69 is provided at a position, from the end edge of the cleaning sheet 61, corresponding to a remaining amount such that cleaning relating to image formation in further number of times cannot be carried out. Then, the above-described first control is effected in detection of the first (first-time) cut-away portion 69 (after the cleaning unit 60 is exchanged), and the above-described second control is effected in detection of the second (second-time) cut-away portion 69. Thus, depending on the remaining amount of the cleaning sheet 61, when the remaining amount thereof is slight (small), the image formation is permitted while warning the user that exchange timing of the cleaning unit 60 or the cleaning sheet 61 approaches (first control). Then, when the remaining amount of the cleaning sheet 61 is finally in a state such that cleaning relating to the image formation effected in the number of further times cannot be performed, the image formation (sheet passing) is properly prohibited (second control). By this, it is possible to reliably avoid a problem such that the image quality lowering due to the improper cleaning of the fixing roller (rotatable heating member).

INDUSTRIAL APPLICABILITY

According to the present invention, there is provided an image forming apparatus in which a cleaning device is capable of achieving sufficient cleaning performance.

The invention claimed is:

1. An image forming apparatus comprising:

an image forming portion for forming a toner image on a recording material;

a heating portion for heating the toner image formed on the recording material by said image forming portion;

a cartridge including a cleaning sheet for cleaning said heating portion, a roller about which said cleaning sheet is wound, and a roller for winding up said cleaning sheet;

a locking portion for locking said cartridge;

a detecting portion for detecting a remaining amount of said cleaning sheet;

a prohibiting portion for prohibiting an image forming operation depending on an output of said detecting portion; and an acting portion for acting on said detecting portion so as to prohibit the image forming operation when said locking portion is in an unlocked state.

2. An image forming apparatus according to claim 1, wherein said acting portion is in a non-acting state on said detecting portion so as to permit the image forming operation when said locking portion is in a locked state.

3. An image forming apparatus according to claim 1, wherein said detecting portion includes:

a photo-interrupter, and a light-blocking portion that blocks light transmitted through said photo-interrupter with displacement of said light-blocking portion based on a remaining amount of the cleaning sheet, and wherein said detecting portion outputs a signal for prohibiting the image forming operation when said photo-interrupter is in a light-blocked state due to said light-blocking portion.

4. An image forming apparatus according to claim 3, wherein said acting portion light-blocks said photo-interrupter when said locking portion is in the unlocked state.

5. An image forming apparatus according to claim 4, wherein said acting portion is in a non-acting state on said detecting portion so as to permit the image forming operation when said locking portion is in a locked state.

6. An image forming apparatus according to claim 1, further comprising a rotatable collecting member, provided so as to be rotated by said heating portion, for collecting toner deposited on said heating portion, wherein said cleaning sheet cleans said heating portion via said rotatable collecting member.

7. An image forming apparatus according to claim 1, wherein said cleaning sheet is wound up by said roller for winding up said cleaning sheet in a predetermined amount every time when image formation is carried out on a predetermined number of recording materials.

8. An image forming apparatus comprising:

an image forming portion for forming a toner image on a recording material;

a heating portion for heating the toner image formed on the recording material by said image forming portion;

a cartridge including a cleaning sheet for cleaning said heating portion, a roller about which said cleaning sheet is wound, and a roller for winding up said cleaning sheet;

a locking portion for locking said cartridge;

a detecting portion for detecting a remaining amount of said cleaning sheet and for outputting a signal for prompting an exchange of said cartridge when the remaining amount of said cleaning sheet reaches a predetermined amount; and an interrelating portion for interrelating said detecting portion and said locking portion so as to output the signal for prompting the exchange of said cartridge when said locking portion is in an unlocked state.

9. An image forming apparatus according to claim 8, wherein said interrelating portion interrelates said detecting portion and said locking portion so as not to output the signal for prompting the exchange of said cartridge when said locking portion is in a locked state.

10. An image forming apparatus according to claim 8, wherein said detecting portion includes:

a photo-interrupter, and a light-blocking portion for blocking light transmitted through said photo-interrupter with displacement of said light-blocking portion based on a remaining amount of the cleaning sheet, and wherein said detecting portion outputs a signal for prompting the exchange of said cartridge when said photo-interrupter is in a light-blocked state by said light-blocking portion.

11. An image forming apparatus according to claim 10, wherein said interrelating portion light-blocks said photo-interrupter when said locking portion is in the unlocked state.

12. An image forming apparatus according to claim 11, wherein said interrelating portion does not light-block said detecting portion so as not to output the signal for prompting the exchange of said cartridge when said locking portion is in a locked state.

13. An image forming apparatus according to claim 8, further comprising a rotatable collecting member, provided so as to be rotated by said heating portion, for collecting toner deposited on said heating portion, wherein said cleaning sheet cleans said heating portion via said rotatable collecting member.

14. An image forming apparatus according to claim 8, wherein said cleaning sheet is wound up by said roller for winding up said cleaning sheet in a predetermined amount every time when image formation is carried out on a predetermined number of recording materials.

15. An image forming apparatus according to claim 8, further comprising a display portion for displaying a message for prompting the exchange of said cartridge.

* * * * *